US006196242B1

(12) United States Patent
Xu

(10) Patent No.: US 6,196,242 B1
(45) Date of Patent: Mar. 6, 2001

(54) HANGING SUN UMBRELLA

(76) Inventor: Zhen Miao Xu, No. 20 Xi Hou Qiang Tou, Cheng Guan, Ninghai County, Zhejiang Province 315600 (CN)

( * ) Notice: Subject to any disclaimer, the term of this patent is extended or adjusted under 35 U.S.C. 154(b) by 0 days.

(21) Appl. No.: 09/076,474

(22) Filed: May 13, 1998

(30) Foreign Application Priority Data

May 14, 1997 (CN) ..... 97217024

(51) Int. Cl.[7] ..... A45B 11/00; A45B 25/02
(52) U.S. Cl. ..... 135/20.1; 135/20.3; 135/21
(58) Field of Search ..... 135/20.1, 21, 20.3

(56) References Cited

U.S. PATENT DOCUMENTS

| | | | | |
|---|---|---|---|---|
| 2,635,616 | * | 4/1953 | Haydu . | |
| 2,661,752 | * | 12/1953 | Kampf . | |
| 2,819,725 | * | 1/1958 | Deisenroth et al. . | |
| 3,410,285 | * | 11/1968 | Small . | |
| 4,386,621 | * | 6/1983 | Redl . | |
| 4,619,281 | * | 10/1986 | Redl et al. | 135/20.3 |
| 4,622,987 | * | 11/1986 | Redl et al. | 135/20.3 |
| 5,116,258 | * | 5/1992 | Vennik | 135/20.3 |
| 5,437,197 | * | 8/1995 | Crisman et al. | 135/20.1 |
| 5,785,069 | * | 7/1998 | Glatz | 135/20.1 |
| 5,937,882 | * | 8/1999 | Harbaugh | 135/20.3 |
| 5,960,806 | * | 10/1999 | Steiner | 135/20.1 |

FOREIGN PATENT DOCUMENTS

| | | | | |
|---|---|---|---|---|
| 0790013 | * | 8/1997 | (EP) | 135/20.1 |

* cited by examiner

*Primary Examiner*—Laura A. Callo
(74) *Attorney, Agent, or Firm*—Smith, Gambrell & Russell, LLP

(57) ABSTRACT

A hanging sun umbrella includes a column; an umbrella frame including a hanging arm; a movable hanging arm holder for movably attaching the hanging arm to the column; a pull arm extending from the column above the hanging arm holder, wherein the hanging arm, the hanging arm holder, and the pull arm provide a cantilevered shape to the umbrella frame; a crank lift provided on the column to move the movable hanging arm holder up and down along the column for opening and closing the umbrella; and an umbrella cloth fitted on the umbrella frame. The umbrella frame, which is attached to the column, includes (a) the hanging arm hingedly attached to the column, (b) a hanging arm bracing hingedly attached to the hanging arm via a tube clamp, (c) six to eight umbrella rods, (d) an umbrella rod bracing hingedly extending from each umbrella rod via a tube clamp, (e) an upper umbrella tray holder hingedly connected to the hanging arm and each umbrella rod, and (f) a lower umbrella tray holder hingedly connected to the hanging arm bracing and each umbrella rod bracing.

17 Claims, 4 Drawing Sheets

HANGING SUN UMBRELLA

BACKGROUND OF THE INVENTION

The present invention relates to a kind of suspension type sun umbrella.

The suspension type sun umbrella, being also called a hanging umbrella, is a kind of large-sized umbrella suitable for use in the family lawn, at a swimming pool side, on a sea beach, in a park, tearoom, field, or other places used for leisure hour enjoyment or sun shading or rain sheltering. At present, the sun umbrellas currently used at home and abroad all include an umbrella column in the center of the umbrella surface, wherein the umbrella column is connected to a base while in use. For this reason, the user under the umbrella can not move about freely due to the obstacle of the column, and in this manner the sun shading area of the sun umbrella can not be fully utilized. In recent years, a kind of suspension type sun umbrella has appeared at home and abroad, which is a fixed type hanging umbrella, similar to a road lamp structure. This hanging umbrella structure, however, cannot be packed up or taken away while not in use. The "outside supporting type sun umbrella" of Patent No. 92221961.3 is also a road lamp type hanging umbrella, which not only affects the service of the umbrella and the environmental scenery, but also is quite inconvenient to use.

SUMMARY OF THE INVENTION

The object of the present invention is to overcome drawbacks of the prior art and provide a kind of hanging sun umbrella capable of being opened up and closed down at will, as well as being dismantled and transferred at will.

The present invention is realized as such: It comprises a column and an umbrella frame composed of a hanging arm; a hanging arm bracing; and 6–8 umbrella rods and associated umbrella rod bracings. The hanging arm is connected to the column and to the hanging arm bracing through square tube clamps, and the umbrella rods connect with the umbrella rod bracings through tube clamps. The hanging arm, hanging arm bracing, umbrella rods, and umbrella rod bracings are supported by upper and lower umbrella tray holders, in a hinged manner. Umbrella cloth is fitted on the umbrella frame. One end of the hanging arm is hinged on a movable holder of the hanging arm, which together with the hanging arm and a pull arm hinged to a pull arm fixed holder located at the column top end makes the umbrella frame take on a cantilever form. A crank lift is provided on the column to move the hanging arm movable holder upward and downward, for realizing opening and closing of the sun umbrella.

The present invention, as compared with the well-known prior art, will allow the sun umbrella to be opened and closed at will through a pull rope control in the crank lift, such that the umbrella will be in a fully folded state when shut down. The present design is of ingenious structure, pretty style, convenient to use, capable of being dismantled and transferred at will, and of a structure that avoids the hindrance characteristics of the column and enlarges the moving about range under the umbrella, and in this manner, provides a kind of sun shading and rain sheltering apparatus of breakthrough conception.

DESCRIPTION OF THE PREFERRED EMBODIMENT

Figure 1:
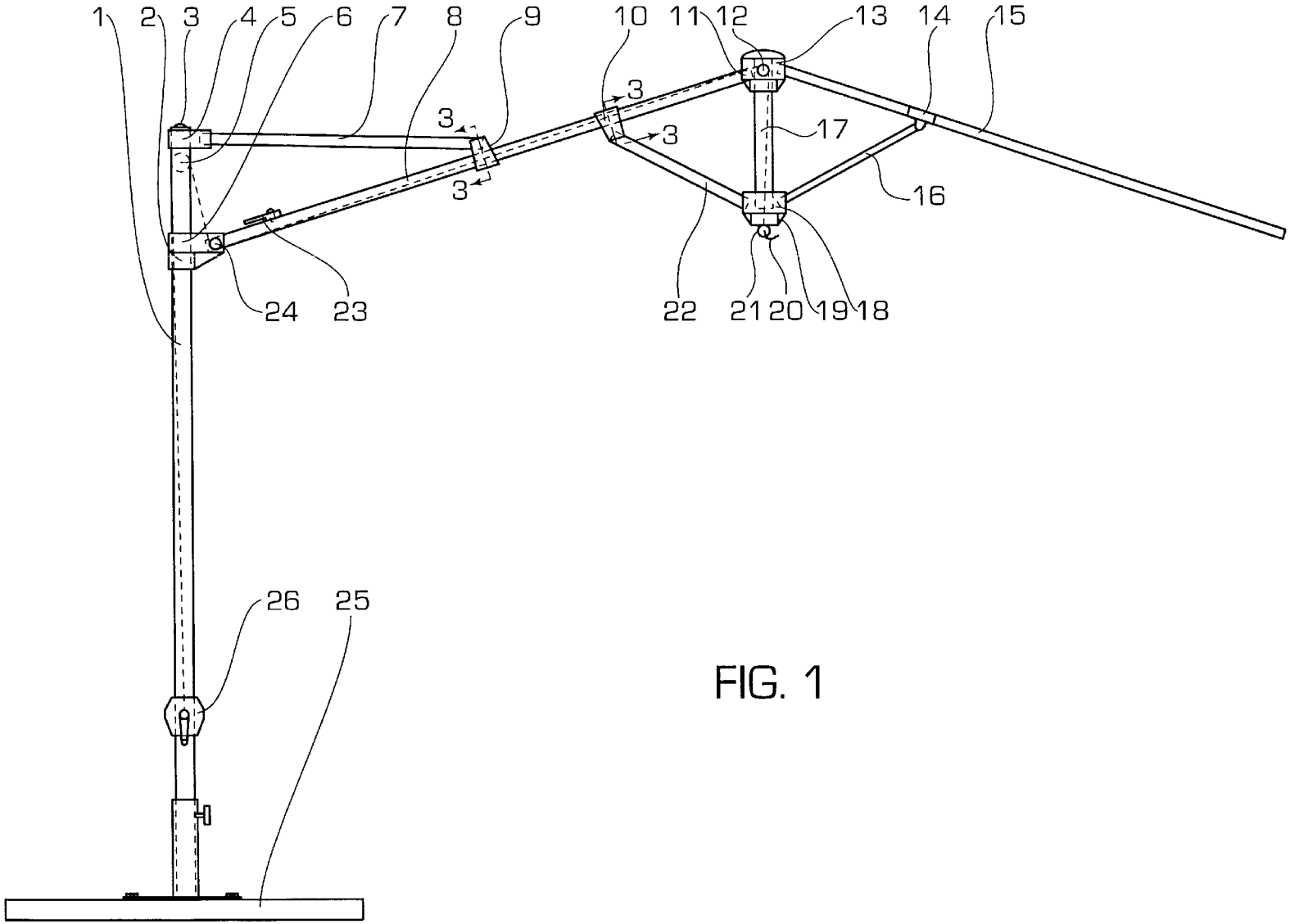
FIG. 1 is an overall structural schematic diagram of the present invention (with the umbrella cloth removed).

A further description is made of the implementation of the present invention in combination with the accompanying drawings as follows:

The hanging sun umbrella (see FIGS. 1 and 1A) comprises a column (1) which is made of an aluminum round tube alloy with eight evenly spaced rectangular integral reinforcing ribs on its inner wall to strengthen its bending property. A movable hanging arm holder (2) for a hinged hanging arm (8) is fitted on the upper end of the column (1), and this holder (2) is capable of ascending and descending on the column (1) to the limit pins (6) fixed on the column (1). A fixed holder (4) for pull arm (7) is fixed at one side of the top end of the column (1), and this holder (4) is used to hinge a pull arm (7). A tube plug (3) closely fits and seals the top face of the column (1). At the lower end of the column (1), a crank lift (26) is provided for opening and closing the sun umbrella. A fabricated chassis assembly (25) is provided at the bottom of column (1) to hold the column (1) in an upright manner.

The sun umbrella has an umbrella frame composed of a hanging arm (8) and a hanging arm bracing (22), hinge joined together at square tube clamp (10). Seven umbrella rods (15) and umbrella rod bracings (16) are provided, hinge joined together at tube clamps (14). Umbrella cloth (41) fits over the umbrella frame. The hanging arm (8) has one end hinged on the hanging arm movable holder (2) and extends through a lifting lug of the square tube clamp (9), provided at the middle of the hanging arm (8) and hinge connected to pull arm (7), which connects with the pull arm fixed holder (4) at the column (1) top end, which jointly provide the umbrella frame with a cantilever form.

The upper umbrella tray holder (13) (see FIGS. 1 and 2) comprises an upper umbrella tray (28) and a center post (17) in rigid connection with it, wherein the center post (17) can let a pull rope pass through. On the periphery of the upper umbrella tray (28), slots (27) are evenly distributed, and in one slot (27), the hinged hanging arm (8) and a pulley (11) are provided. The pulley (11) is disposed at an open side of the hanging arm (8) and is fixed on the upper umbrella tray (28) by a cross pin. Another pulley (12) is provided at the center position of the upper umbrella tray (28). In the rest of the slots (27), hinged umbrella rods (15) are provided, and the top face of the upper tray holder (13) is sealed by another tube plug.

The lower umbrella tray holder (18) (see FIG. 1) comprises a lower umbrella tray similar in structure to the upper umbrella tray (28). On the periphery of the lower umbrella tray, limit slots are evenly distributed, like the slots (27) provided in the upper umbrella tray (28). In one slot, the hanging arm bracing (22) is hinged, and in the rest of the slots, a hinged bracing (16) is provided. The lower portion of the lower umbrella tray is provided with a knot bead (21), which cooperates with a knotted pull rope (20) and a knot pin (19) to prevent the bead from separating. The opposite end of the hanging arm bracing (22) is hinged on the square tube clamp (10), which is fixed to the hanging arm (8). The opposite end of each bracing (16) is hinged to the corresponding tube clamp (14) fixed on the umbrella rod (15).

Figure 3:
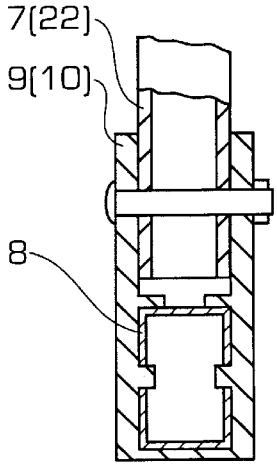
FIG. 3 is a sectional view along section lines 3—3 of FIG. 1.

The hanging arm (8) (see FIGS. 1 and 3) is a rectangular aluminum alloy tube with holes drilled at both sides, and the square tube clamps (9) and (10) are sleeved outside the hanging arm (8). The square tube clamps (9) and (10) are hinged respectively with the pull arm (7) and the hanging arm bracing (22). One end of the hanging arm (8) is hinged with the hanging arm movable holder (2), which has an open side with a pulley (24) fitted therein.

Figure 4:
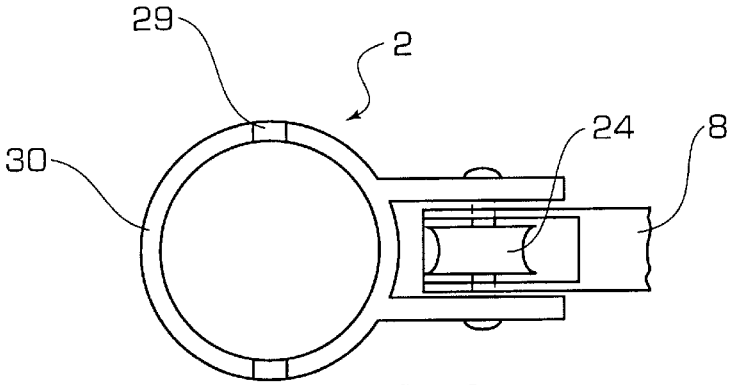
FIG. 4 is a top view of Element No. 2, the hanging arm movable holder of FIG. 1.

The hanging arm movable holder (2) (see FIGS. 1 and 4) comprises a movable holder (30) sleeved on the column (1), and the upper portion of the movable holder (30) includes limit slots (29) to engage the limit dowels (6) fixed on the column (1) as a height limit of the sun umbrella after having been opened up, and to limit any rightward swing. In the movable holder opening is placed the hanging arm (8), and the pulley (24) is located at the hanging arm open end of the movable holder (30). The movable holder (30), the pulley (24), and the hanging arm (8) are joined into a hinged structure by a bolt. The ascending of hanging arm movable holder (2) is controlled by the crank lift (26), and releasing the control of the lift (26) will make the hanging arm movable holder (2) descend by gravitational action and make the umbrella come into a folded state.

Figure 5:
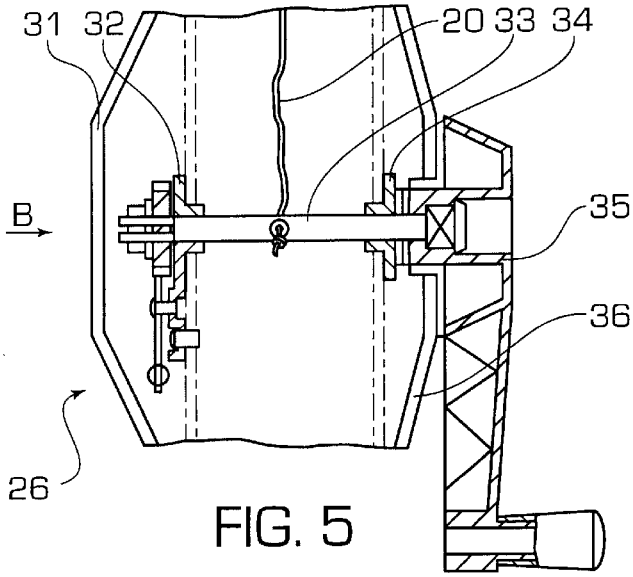
FIG. 5 is a sectional view of Element No. 26, the crank lift of FIG. 1.
Figure 6:
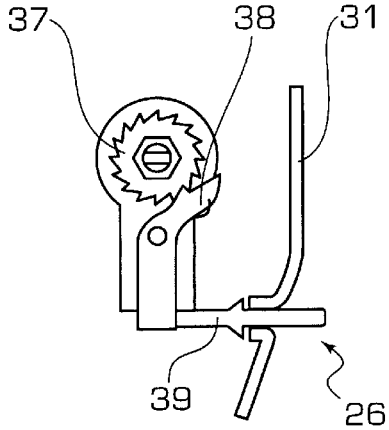
FIG. 6 is a schematic diagram of the locking and unlocking mechanism from the B-direction as shown in FIG. 5 (with the rear shell removed).

The crank lift (26) (see FIGS. 1, 5, and 6) comprises front and rear shells (36) and (31) fixed outside the column (1), wherein the two ends of a cranking shaft (33) are supported by front and rear bushings (34) and (32). A crank (35) is in transmitting connection with the cranking shaft (33), using a tenon connection as shown in the Figure or other fixed connection. At the rear side of the cranking shaft (33), a locking and unlocking mechanism of the lift is provided. A hole at the middle of the cranking shaft (33) is provided, through which the pull rope (20) is threaded, secured with a knot.

The locking and unlocking mechanism comprises a ratchet (37) fitted on the overhanging end of the cranking shaft (33); a pawl piece (38) in mesh with the ratchet (37), hinged on the rear bushing (32); and an unlocking button (39) supported through the rear shell (31) and able to push the pawl piece (38) to disengage the pawl piece (38) and the ratchet (37).

During opening and closing of the sun umbrella, the pull rope (20) bundled and knotted on the cranking shaft (33) first threads the column (1), then rounds the pulley (5) fitted at the column (1) top end, passes around the pulley (24) on the hanging arm movable holder (2), through the hanging arm (8) inner chamber to the pulley (11) at the hanging arm (8) top end opening, around the pulley (12) in the upper umbrella tray holder (13), through the center post (17) inner hole, and to the knot bead (21) at the lower portion of the lower umbrella tray holder (18) and knotted.

Figure 7A:
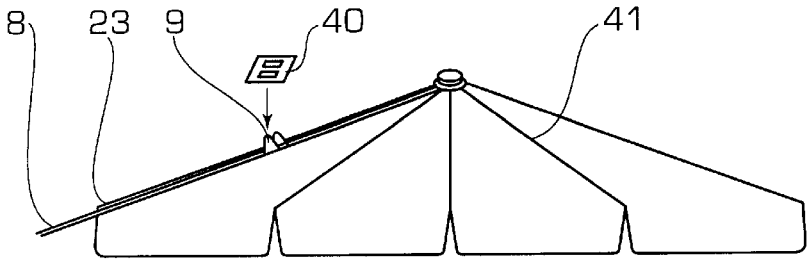
FIG. 7A is a schematic diagram of the umbrella in an open state.
Figure 7B:
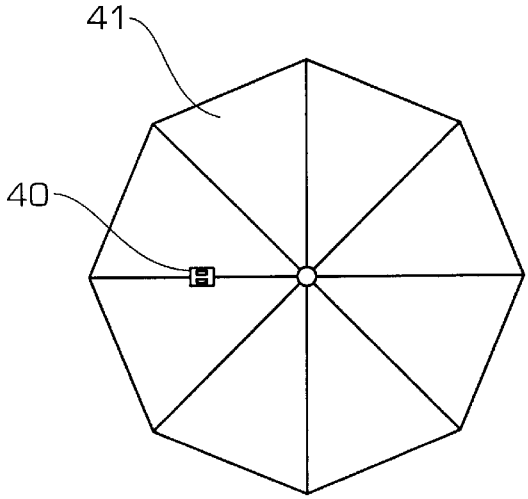
FIG. 7B is a top view of the umbrella in an open state.

The umbrella cloth (41) attached on the umbrella frame allows the pull arm (7) to extend outside the umbrella cloth, and hence the umbrella cloth at the square tube clamp area (9) must be perforated. In order to prevent rainwater from entering that perforation, a leak proof cover (40) is provided at the perforated area of the umbrella cloth. Attachment of the umbrella cloth (41) with the hanging arm (8) and the umbrella rods (15) is realized using umbrella cloth bag clamps (23) (see FIGS. 1 and 7).

Figure 1A:
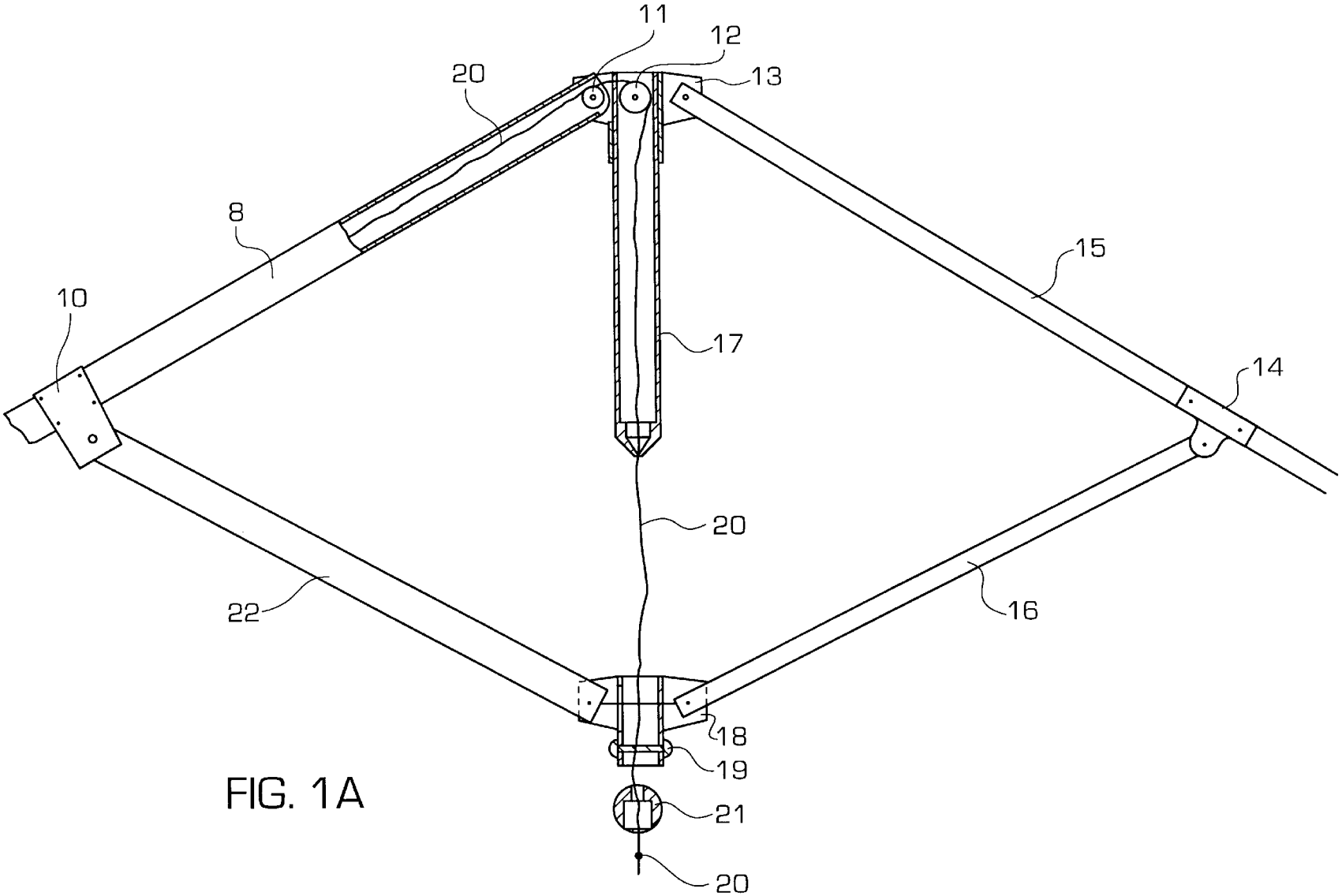
FIG. 1A is an enlarged view of a portion of FIG. 1.
Figure 2:
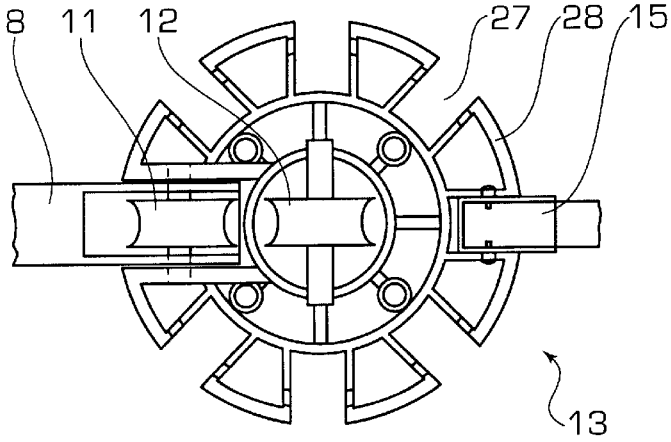
FIG. 2 is a top view of Element No. 13, the upper umbrella tray holder of FIG. 1.
Figure 8:
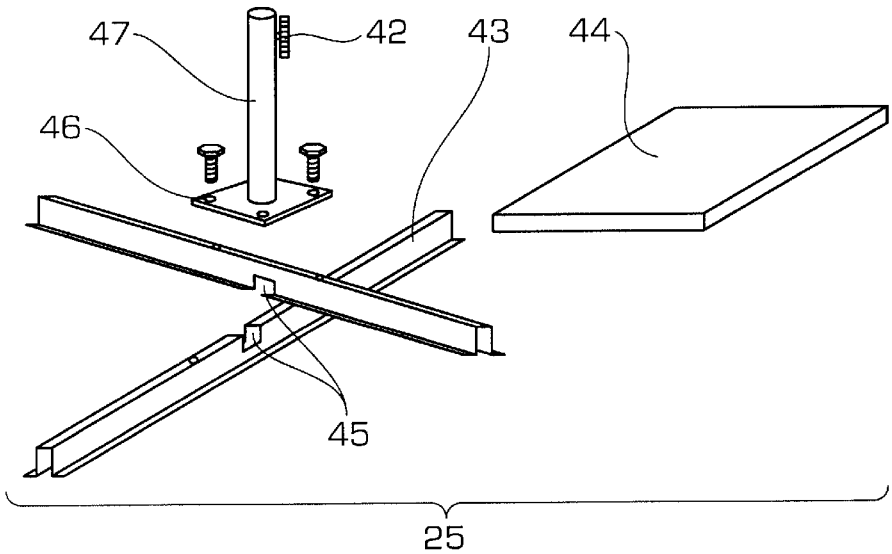
FIG. 8 is a structural diagram of Element No. 25, the chassis assembly.

In order to facilitate dismantling and transferring of the sun umbrella, it is possible to provide a chassis assembly (25) at the lower end of the column (1) (see FIGS. 1 and 8). This chassis assembly (25) comprises two mutually intersecting channel steel chassis (43) with U-shaped skirts, being connected to one another by male and female notches (45), which are punched from 2 mm steel plate. Symmetric holes are provided at the top of each channel steel chassis (43), with welded nuts in the interior. A fixing plate (46) can be fixed into the symmetric holes by screws. A sleeve (47) is welded integral with the plate (46), and on the sleeve (47) is provided a tightening screw (42) which will tighten the column (1) after it is inserted into the sleeve (47). In order to prevent the sun umbrella from toppling and falling under influence of a one-sided force, a hold down plate (44) with a coincident intersecting angle is used to hold down the chassis skirt, such that the two chassis (43) of the present embodiment form a mutual "cross" intersection, and the hold down plate (44) is square.

Figure 9:
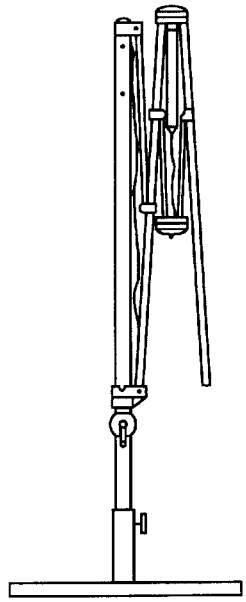
FIG. 9 is a schematic diagram of the sun umbrella in a folded state.

The dynamic structure of the present invention is as follows: When it is required to open up the sun umbrella, the crank (35) is turned to bring the cranking shaft (33) into rotation, the pull rope (20) is wound on the cranking shaft (33), the hanging arm movable holder (2) ascends slowly, the pull arm (7) makes the hanging arm (8) receive an upward force and halts at the upper stop (6), and at this moment, due to sticking of the ratchet (37) by pawl piece (38) which keeps the crank shaft (33) from reverse turning, the pull rope (20) is locked and the sun umbrella will be fully opened. If it is required to set down the sun umbrella, the unlocking button (39) is pressed to unlock the pawl piece (38) and ratchet (37), the cranking shaft (33) will rotate freely to loosen the pull rope (20), and at this moment, the upper and lower umbrella tray holders (13) and (18) descend by themselves, the pull arm (7) droops together along with the hanging arm (8), and the hanging arm movable holder (2) slides downward to the lower stop (i.e., until it touches the crank lift (26)), and then the sun umbrella will remain in a folded state (see FIG. 9).

What is claimed is:

1. A hanging sun umbrella comprising:

a column;

an umbrella frame attached to the column, wherein the umbrella frame includes:

a hanging arm hingedly attached to the column, a hanging arm bracing hingedly attached to the hanging arm via a tube clamp, six to eight umbrella rods, an umbrella rod bracing hingedly extending from each umbrella rod via a tube clamp, an upper umbrella tray holder hingedly connected to the hanging arm and each umbrella rod, a lower umbrella tray holder hingedly connected to the hanging arm bracing and each umbrella rod bracing;

a movable hanging arm holder for movably attaching the hanging arm to the column;

a pull arm extending from the column above the hanging arm holder, wherein the hanging arm, the hanging arm holder, and the pull arm provide a cantilevered shape to the umbrella frame;

a crank lift provided on the column to move the movable hanging arm holder up and down along the column for opening and closing the umbrella, wherein the crank lift includes:

a first shell and a second shell together extending around the column, a crank shaft having a first end supported in a first bushing and a second end supported in a second bushing, a crank connected with the crank shaft, and a locking and unlocking mechanism for selectively allowing movement of the crank shaft to facilitate opening and closing of the umbrella; and an umbrella cloth fitted on the umbrella frame.

2. A hanging sun umbrella according to claim 1, wherein:

the upper umbrella tray holder includes an upper umbrella tray and a first pulley;

a center post connects the upper umbrella tray holder with the lower umbrella tray holder;

a plurality of evenly distributed slots are provided on a periphery of the upper umbrella tray;

the hanging arm, which includes a second pulley, extends into one of the slots; and one of the umbrella rods extends into each of the remaining slots such that each slot includes one of the umbrella rods or the hanging arm, respectively.

3. A hanging sun umbrella according to claim 1, wherein:

the lower umbrella tray holder includes a lower umbrella tray;

a plurality of evenly distributed slots are provided on a periphery of the lower umbrella tray;

the hanging arm bracing extends into one of the slots;

one of the umbrella rod bracings extends into each of the remaining slots such that each slot includes one of the umbrella rod bracings or the hanging arm bracing, respectively;

a knot bead is provided at a lower end of the lower umbrella tray; and a knot pin is provided to prevent the knot bead from separating from a knotted pull rope provided for opening and closing the umbrella.

4. A hanging sun umbrella according to claim 1, wherein a cross section of the hanging arm is in a shape of a rectangular tube, and wherein the tube clamp provided to connect the hanging arm with the hanging arm bracing and a tube clamp provided to connect the hanging arm with the pull arm are shaped so as to receive the rectangular tube of the hanging arm.

5. A hanging sun umbrella according to claim 1, wherein the movable hanging arm holder includes: an opening to receive the column and limit slots to engage limit dowels provided on the column; and wherein the hanging arm is connected to the movable hanging arm holder by a rivet, and wherein a pulley is provided on the rivet.

6. A hanging sun umbrella according to claim 1, wherein the locking and unlocking mechanism includes a ratchet fitted on an overhanging end of the crank shaft, a pawl piece meshed with the ratchet, and an unlocking button extending through a hole provided in one of the first or second shells, wherein the button can be selectively pushed to disengage the pawl piece from the ratchet.

7. A hanging sun umbrella according to claim 1, wherein the umbrella cloth is perforated at a location so as to allow the pull arm to connect with the hanging arm, and a leakproof cover is provided at the location.

8. A hanging sun umbrella comprising:

a column;

an umbrella frame attached to the column, wherein the umbrella frame includes:

a hanging arm hingedly attached to the column, a hanging arm bracing hingedly attached to the hanging arm via a tube clamp, six to eight umbrella rods, an umbrella rod bracing hingedly extending from each umbrella rod via a tube clamp, an upper umbrella tray holder hingedly connected to the hanging arm and each umbrella rod, a lower umbrella tray holder hingedly connected to the hanging arm bracing and each umbrella rod bracing;

a movable hanging arm holder for movably attaching the hanging arm to the column;

a pull arm extending from the column above the hanging arm holder, wherein the hanging arm, the hanging arm holder, and the pull arm provide a cantilevered shape to the umbrella frame;

a crank lift provided on the column to move the movable hanging arm holder up and down along the column for opening and closing the umbrella, wherein the crank lift includes:

a first shell and a second shell together extending around the column, a crank shaft having a first end supported in a first bushing and a second end supported in a second bushing, a crank connected with the crank shaft, and a locking and unlocking mechanism for selectively allowing movement of the crank shaft to facilitate opening and closing of the umbrella;

an umbrella cloth fitted on the umbrella frame; and a pull rope wound on the crank shaft, around a first pulley provided at a top end of the column, around a second pulley provided with the movable hanging arm holder, along a third pulley at an end of the hanging arm located away from the movable hanging arm holder, around a fourth pulley provided with the upper umbrella tray holder, and to the lower umbrella tray holder.

9. A hanging sun umbrella comprising:

a column;

an umbrella frame attached to the column, wherein the umbrella frame includes:

a hanging arm hingedly attached to the column, a hanging arm bracing hingedly attached to the hanging arm via a tube clamp, six to eight umbrella rods, an umbrella rod bracing hingedly extending from each umbrella rod via a tube clamp, an upper umbrella tray holder hingedly connected to the hanging arm and each umbrella rod, a lower umbrella tray holder hingedly connected to the hanging arm bracing and each umbrella rod bracing;

a movable hanging arm holder for movably attaching the hanging arm to the column;

a pull arm extending from the column above the hanging arm holder, wherein the hanging arm, the hanging arm holder, and the pull arm provide a cantilevered shape to the umbrella frame;

a crank lift provided on the column to move the movable hanging arm holder up and down along the column for opening and closing the umbrella;

an umbrella cloth fitted on the umbrella frame;

a chassis assembly engaged at a lower end of the column, wherein the chassis assembly includes two mutually intersecting chassis, each having a U-shaped skirt and a notch, wherein the two chassis engage one another at their respective notch;

a fixing plate connected with both chasses;

a sleeve extending from the fixing plate;

a tightening screw provided on the sleeve for fixing the column in the sleeve; and a hold down plate for holding the two chasses.

10. A hanging sun umbrella according to claim 9, wherein:

the upper umbrella tray holder includes an upper umbrella tray and a first pulley;

a center post connects the upper umbrella tray holder with the lower umbrella tray holder;

a plurality of evenly distributed slots are provided on a periphery of the upper umbrella tray;

the hanging arm, which includes a second pulley, extends into one of the slots; and one of the umbrella rods extends into each of the remaining slots such that each slot includes one of the umbrella rods or the hanging arm, respectively.

11. A hanging sun umbrella according to claim 9, wherein:

the lower umbrella tray holder includes a lower umbrella tray;

a plurality of evenly distributed slots are provided on a periphery of the lower umbrella tray;

the hanging arm bracing extends into one of the slots;

one of the umbrella rod bracings extends into each of the remaining slots such that each slot includes one of the umbrella rod bracings or the hanging arm bracing, respectively;

a knot bead is provided at a lower end of the lower umbrella tray; and a knot pin is provided to prevent the knot bead from separating from a knotted pull rope provided for opening and closing the umbrella.

12. A hanging sun umbrella according to claim 9, wherein a cross section of the hanging arm is in a shape of a rectangular tube, and wherein the tube clamp provided to connect the hanging arm with the hanging arm bracing and a tube clamp provided to connect the hanging arm with the pull arm are shaped so as to receive the rectangular tube of the hanging arm.

13. A hanging sun umbrella according to claim 9, wherein the movable hanging arm holder includes: an opening to receive the column and limit slots to engage limit dowels provided on the column; and wherein the hanging arm is connected to the movable hanging arm holder by a rivet, and wherein a pulley is provided on the rivet.

14. A hanging sun umbrella according to claim 9, wherein the crank lift includes:

a first shell and a second shell together extending around the column, a crank shaft having a first end supported in a first bushing and a second end supported in a second bushing, a crank connected with the crank shaft, and a locking and unlocking mechanism for selectively allowing movement of the crank shaft to facilitate opening and closing of the umbrella.

15. A hanging sun umbrella according to claim 14, wherein the locking and unlocking mechanism includes a ratchet fitted on an overhanging end of the crank shaft, a pawl piece meshed with the ratchet, and an unlocking button extending through a hole provided in one of the first or second shells, wherein the button can be selectively pushed to disengage the pawl piece from the ratchet.

16. A hanging sun umbrella according to claim 14, wherein a pull rope is wound on the crank shaft, around a first pulley provided at a top end of the column, around a second pulley provided with the movable hanging arm holder, along a third pulley at an end of the hanging arm located away from the movable hanging arm holder, around a fourth pulley provided with the upper umbrella tray holder, and to the lower umbrella tray holder.

17. A hanging sun umbrella according to claim 9, wherein the umbrella cloth is perforated at a location so as to allow the pull arm to connect with the hanging arm, and a leakproof cover is provided at the location.

* * * * *